US012098008B2

(12) United States Patent
Ball et al.

(10) Patent No.: US 12,098,008 B2
(45) Date of Patent: Sep. 24, 2024

(54) ARTICLE CARRIER, BLANK AND METHOD OF CONSTRUCTION

(71) Applicant: WESTROCK PACKAGING SYSTEMS, LLC, Atlanta, GA (US)

(72) Inventors: Nathaniel B. Ball, Richmond, VA (US); Lauren N. Chesnet, Henrico, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 57 days.

(21) Appl. No.: 17/909,411

(22) PCT Filed: Mar. 5, 2021

(86) PCT No.: PCT/US2021/021099

§ 371 (c)(1),
(2) Date: Sep. 5, 2022

(87) PCT Pub. No.: WO2021/178806

PCT Pub. Date: Sep. 10, 2021

(65) Prior Publication Data

US 2023/0091859 A1 Mar. 23, 2023

Related U.S. Application Data

(60) Provisional application No. 62/986,163, filed on Mar. 6, 2020.

(51) Int. Cl.
*B65D 71/46* (2006.01)

(52) U.S. Cl.
CPC .... *B65D 71/46* (2013.01); *B65D 2571/00141* (2013.01); *B65D 2571/0029* (2013.01);
(Continued)

(58) Field of Classification Search
CPC ..... B65D 71/40; B65D 71/42; B65D 71/44; B65D 71/46; B65D 2571/00141
(Continued)

(56) References Cited

U.S. PATENT DOCUMENTS 4,304,329 A * 12/1981 Graser ..... B65D 71/42 206/148
4,378,879 A * 4/1983 Killy ..... B65D 71/44 206/427

(Continued)

FOREIGN PATENT DOCUMENTS

| | | | |
|---|---|---|---|
| EP | 0199336 | A2 | 10/1986 |
| WO | 2011009434 | A1 | 1/2011 |
| WO | 2014179258 | A1 | 11/2014 |

OTHER PUBLICATIONS

International Search Report Issued in PCT/US2021/021099 dated Jun. 24, 2021.

*Primary Examiner* — Bryon P Gehman
(74) *Attorney, Agent, or Firm* — Brian J. Goldberg; Rohini K. Garg

(57) ABSTRACT

Aspects of the disclosure relate to an article top engaging device, a carrier (90) for packaging one or more articles (B) and a blank (10) for forming the carrier. The article carrier comprises a sleeve structure (12/18) defining at least in part an interior of the article carrier for receiving at least one article, the sleeve structure including at least one substantially planar portion. An end closure structure (14/16) is hingedly connected to a first end of the sleeve structure to at least partially close the first end. At least one glue flap (20, 22) is hingedly connected to the planar portion of the sleeve structure for pivotal movement with respect to the planar portion. The at least one glue flap is disposed generally in the plane of the planar portion of the sleeve structure when the at least one article is received in the interior of the article carrier.

20 Claims, 7 Drawing Sheets

(52) U.S. Cl.
CPC ..... *B65D 2571/0066* (2013.01); *B65D 2571/00728* (2013.01)

(58) Field of Classification Search
USPC ..... 206/148–149, 152–158, 175, 427, 434
See application file for complete search history.

(56) References Cited

U.S. PATENT DOCUMENTS 5,513,753 A 5/1996 Jensen
5,538,133 A * 7/1996 Campbell ..... B65D 71/42 206/427

* cited by examiner

ARTICLE CARRIER, BLANK AND METHOD OF CONSTRUCTION

CROSS-REFERENCE RELATED APPLICATIONS

This Application is a U.S. 371 National Phase Patent Application of International PCT Patent Application No. PCT/US2021/021099, filed on Mar. 5, 2021, which claims priority to U.S. Provisional Patent Application No. 62/986,163, filed on Mar. 6, 2020. The entire contents of these applications are incorporated herein by reference.

TECHNICAL FIELD

The present invention relates to article carriers, to blanks for forming article carriers and to methods of construction. More specifically, but not exclusively, the invention relates to a package having one or more panels adhesively secured to at least one article disposed therein.

BACKGROUND

In the field of packaging it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is well known to provide top engaging article carriers in which an opening or aperture is formed in a panel of the carrier and at least a portion of an article is received in the opening and engaged by portions of the panel surrounding the opening.

The present invention seeks to provide an improvement in the field of cartons, typically formed from paperboard or the like.

SUMMARY

A first aspect of the invention provides an article carrier for packaging at least one article. The article carrier comprises a sleeve structure defining at least in part an interior of the carrier for receiving at least one article. The sleeve structure includes at least one substantially planar portion. An end closure structure is hingedly connected to a first end of the sleeve structure to at least partially close the first end. The article carrier comprises at least one glue flap hingedly connected to the planar portion of the sleeve structure for pivotal movement with respect to the planar portion. The at least one glue flap is disposed generally in the plane of the planar portion of the sleeve structure when the at least one article is received in the interior of the carrier.

A second aspect of the invention provides an article carrier for packaging a plurality of articles arranged in one or more rows. The article carrier comprises a sleeve structure defining at least in part an interior of the carrier for receiving at least one article, the sleeve structure includes at least one substantially planar portion. An end closure structure is hingedly connected, by a fold line, to a first end of the sleeve structure to at least partially close the first end. The article carrier comprises at least one glue flap hingedly connected, by a hinged connection, to the planar portion of the sleeve structure for pivotal movement with respect to the planar portion. The at least one glue flap is disposed generally in the plane of the planar portion of the sleeve structure when the at least one article is received in the interior of the carrier.

Optionally, the length of the hinged connection is equal to or less than D×(N−1), where "D" is the diameter of the body portion of an article and "N" is the number of the articles in a row of articles with which the planar portion of the sleeve structure is in contact.

Optionally, the at least one glue flap comprises a length dimension and the length of the hinged connection is less than the length dimension of the at least one glue flap.

Optionally, the at least one glue flap comprises a first length dimension and the end closure structure provides a top panel having a second length dimension, the first length dimension being less than the second length dimension of the top panel.

Optionally, the length of the hinged connection is generally equal to the length the fold line.

Optionally, the fold line is arranged to be substantially linear between its opposed ends when the article carrier is fully loaded with articles.

A third aspect of the invention provides a blank for forming an article carrier. The blank comprises a pair of straps for forming a sleeve structure which defines an interior of the carrier for receiving at least one article. An end closure section extends between the pair of straps and is hingedly connected thereto along opposed end edges thereof. The blank comprises at least one glue flap hingedly connected to at least one of the straps. The at least one glue flap may be formed in part from the at least one of the straps.

A fourth aspect of the invention provides a package comprising an article carrier and at least one article. Each article comprises opposed ends defining a longitudinal axis therebetween and a height dimension defined between the opposed ends. The height dimension extends along the longitudinal axis. The article carrier comprises a sleeve structure, an end closure structure at least partially closing an end of the sleeve structure, and at least one glue flap. The sleeve structure defines a sleeve axis and encircles the at least one article such that the sleeve axis is parallel to the longitudinal axis of the at least one article. The end closure structure is hingedly connected to a first end of the sleeve structure along at least one first end fold line. The end closure structure is disposed at least in part along the end of the at least one article. The at least one glue flap is hingedly connected to the sleeve structure along a glue flap fold line. The at least one glue flap is adhesively secured to the at least one article. The at least one glue flap extends from the glue flap fold line to a free edge located at a position opposing the glue flap fold line. The height dimension of the at least one article is equal to or greater than the distance between the free edge of the at least one glue flap and the at least one first end fold line.

A fifth aspect of the invention provides a method for forming a package. The package comprises an article carrier and at least one article. Each article has a height and an end defining a longitudinal axis extending along the height. The article carrier comprises a sleeve structure, an end closure structure, and at least one glue flap. The method comprises moving at least one of the article carrier and the at least one article toward the other such that the sleeve structure encircles the at least one article and such that a sleeve axis of the sleeve structure is parallel to the longitudinal axis of the at least one article. The end closure structure is brought into a position in which the end closure structure is disposed at least in part along the first end of the at least one article. The at least one glue flap is folded with respect to the sleeve structure to expose an outside surface of the at least one article and to expose an inside surface of the at least one glue flap. An amount of adhesive is applied to one of the outside surface of the at least one article and the inside surface of the at least one glue flap. The method also comprises folding the at least one glue flap back to the initial position and adhesively securing the at least one glue flap to the at least one article.

A sixth aspect of the invention provides a package comprising an article carrier and a plurality of articles arranged in one or more rows. The article carrier comprises a sleeve structure defining at least in part an interior of the carrier for receiving at least one article. The sleeve structure includes at least one substantially planar portion. An end closure structure is hingedly connected, by a fold line, to a first end of the sleeve structure to at least partially close the first end. At least one glue flap is hingedly connected, by a hinged connection, to the planar portion of the sleeve structure for pivotal movement with respect to the planar portion. The at least one glue flap is disposed generally in the plane of the planar portion of the sleeve structure when the at least one article is received in the interior of the carrier.

Optionally, the length of the hinged connection is equal to or less than $D\times(N-1)$, where "D" is the diameter of the body portion of an article and "N" is the number of the articles in a row of articles with which the planar portion of the sleeve structure is in contact.

Optionally, at least one glue flap comprises a length dimension and the length of the hinged connection is less than the length dimension of the at least one glue flap.

Optionally, at least one glue flap comprises a first length dimension and the end closure structure provides a top panel having a second length dimension, the first length dimension being less than the second length dimension of the top panel.

Optionally, the length of the hinged connection is generally equal to the length the fold line.

Optionally, the fold line is arranged to be substantially linear between its opposed ends.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the package, blanks, carriers and methods are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks, carriers and methods described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
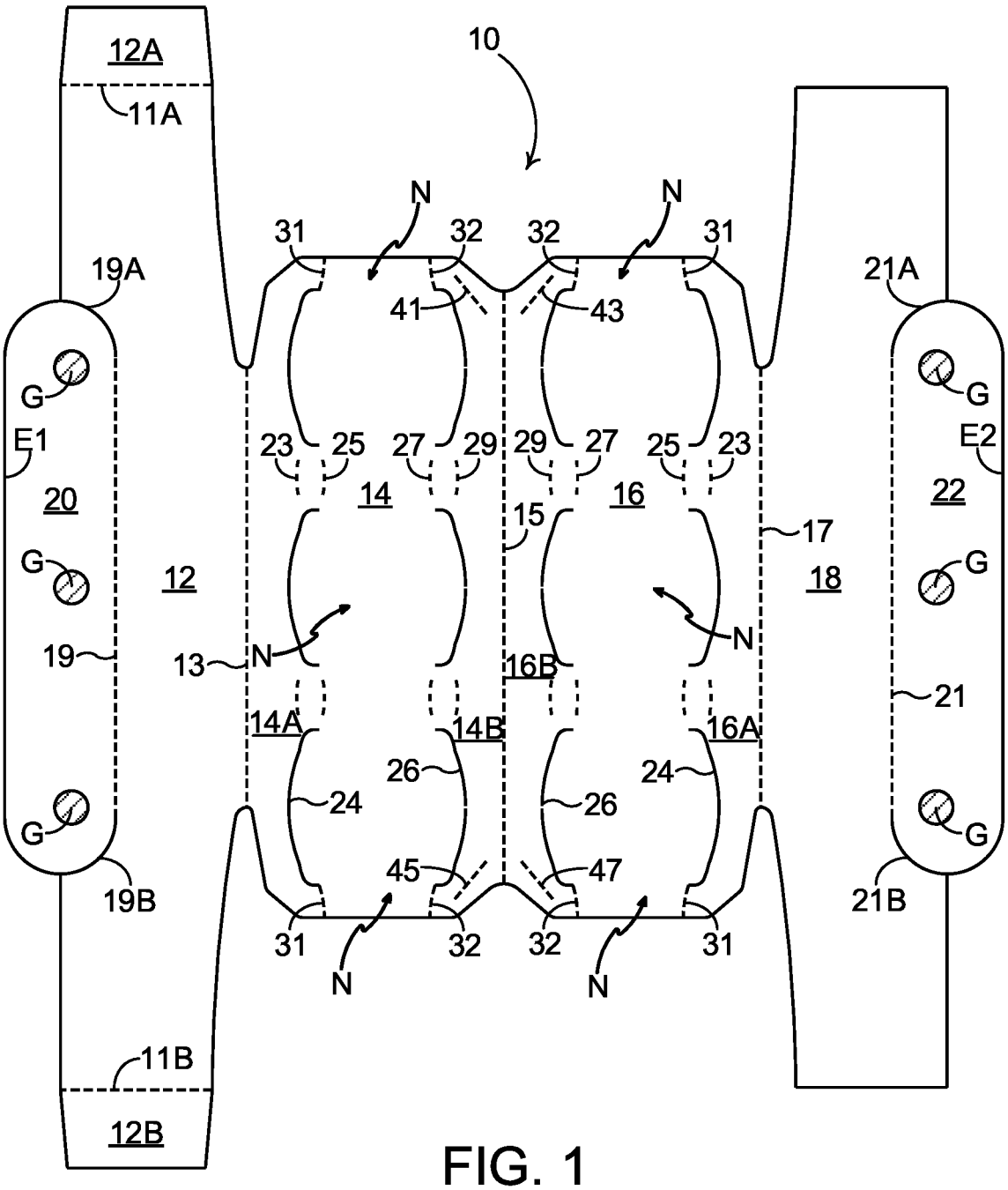
FIG. 1 is a plan view from above of a blank for forming a carrier according to a first embodiment.
Figure 6:
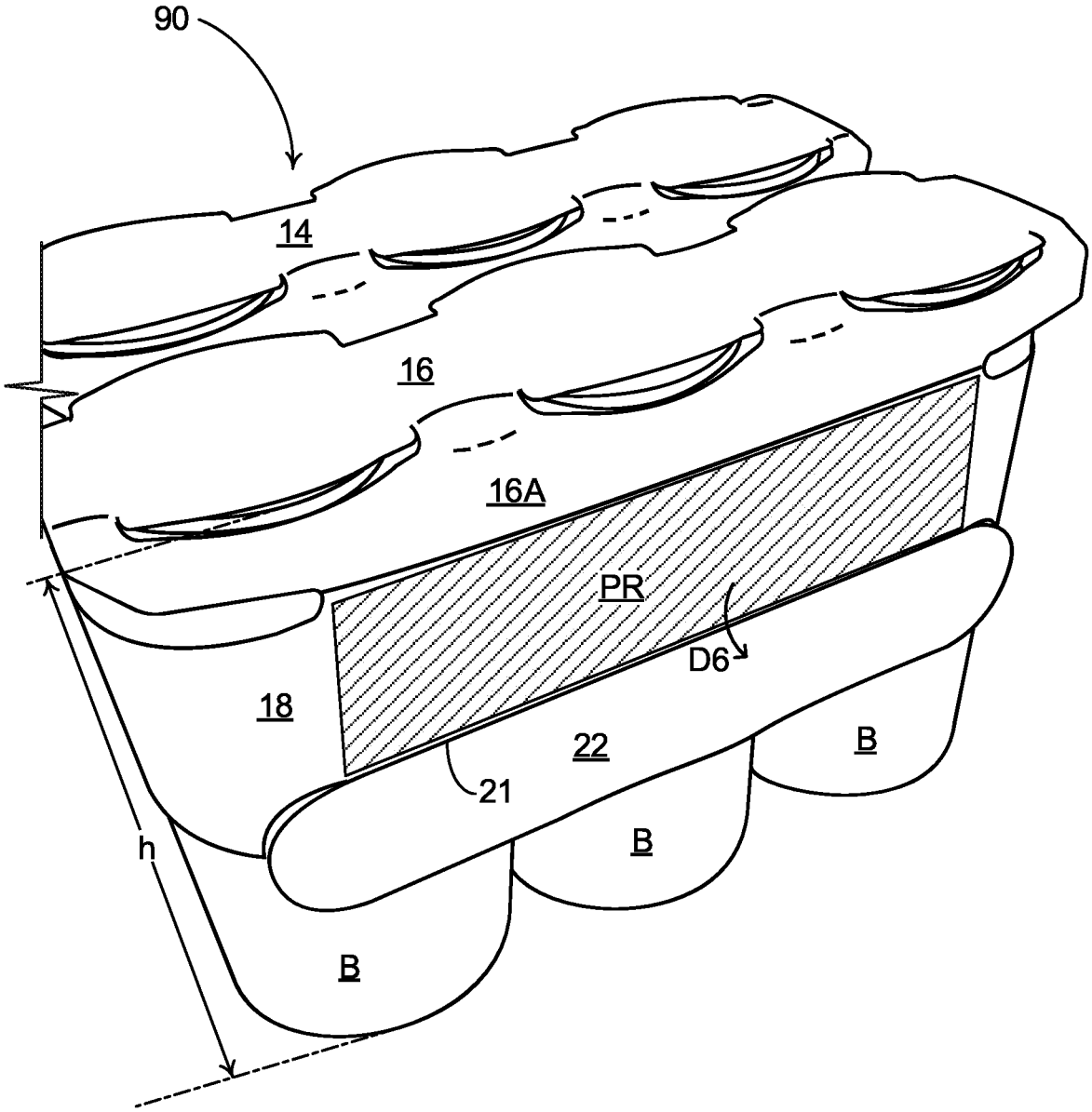
FIG. 6 is a perspective view from above of an article carrier formed from the blank of FIG. 1.

Referring to FIG. 1, there is shown a plan view of a blank 10 which is capable of forming a carton or carrier 90, as shown in FIG. 6, for containing and carrying a group of primary products such as, but not limited to, bottles or cans, hereinafter referred to as articles B. The blank 10 forms a secondary package for packaging at least one primary product container or package.

In the embodiments detailed herein, the terms "carton" and "carrier" refer, for the non-limiting purpose of illustrating the various features of the invention, to a container for engaging and carrying articles, such as primary product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like.

The blank 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structures or cartons described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiment, the blanks 10 is configured to form a carton or carrier 90 for packaging an exemplary arrangement of exemplary articles B. In the embodiment illustrated in FIGS. 1 to 6, the arrangement is a 3×2 matrix or array; the embodiment comprises two rows of three articles, and the articles B are beverage cans. Alternatively, the blank 10 can be configured to form a carrier for packaging other types, number and size of articles and/or for packaging articles in a different arrangement or configuration.

FIG. 1 illustrates an embodiment of the present disclosure and shows a blank 10 for forming a carrier 90 shown in FIG. 6. The carrier 90 takes the form of a top-engaging clip or carrier. In other embodiments other carton types may be employed. The blank 10 comprises a plurality of main panels 12, 14, 16, 18 hinged one to the next in a linear series by hinged connections in the form of fold lines 13, 15, 17.

A first main panel 12 forms a first portion of a strap for surrounding a group of articles B. A second main panel 14 together with a third main panel 16 form a top panel of the carrier 90. A fourth main panel 18 forms a second portion of a strap for surrounding a group of articles B.

The first main panel 12 may be considered to form a first side wall of a carrier 90 and a first portion of each of a first end wall and a second end wall. The fourth main panel 18 may be considered to form a second side wall of a carrier 90 and a second portion of each of the first and second end walls. The first main panel 12 and the fourth main panel 18 together form a sleeve 12/18 for encircling a group of articles B.

The first main panel 12 comprises a pair of opposed marginal end portions 12A, 12B which are hingedly connected to an intermediate portion of the first main panel 12 by a respective hinged connection in the form of a fold line 11A, 11B. Each of the pair of opposed marginal end portions 12A, 12B forms a securing panel 12A, 12B. The securing panels 12A, 12B may be secured to inner or outer surfaces of the fourth main panel 18.

Optionally, the top panel 14/16 comprises at least one article engagement structure N. The illustrated embodiment comprises six article engagement structures N. Three article engagement structures N are provided in the second main panel 14. Three article engagement structures N are provided in the third main panel 16.

Each of the article engagement structures N are substantially the same in construction and comprise a pair of cut or severance lines 24, 26. The severance lines 24, 26 are substantially "U" or "C" shaped. A first severance line 24 is arranged in opposition to a second severance line 26. The first and second severance lines 24, 26 are spaced apart from each other and define tabs extending outwardly.

Each of the first and second severance lines 24, 26 defines, at least in part, an opening in the top panel 14/16 in an erected carrier 90. The openings receive portions of a respective article B.

The second main panel 14 comprises opposed marginal side portions 14A, 14B. A first outer marginal side portion 14A may form a first outer shoulder panel 14A in an erected condition.

The first outer shoulder panel 14A is defined in part by the fold line 13 between the second main panel 14 and the first main panel 12. The first outer shoulder panel 14A is defined in part by the first severance lines 24 of each of the article engagement structures N provided within second main panel 14.

At least one first fold line 23, 25 may be provided between adjacent pairs of the first severance lines 24. The at least one first fold line 23, 25 defines in part the first outer shoulder panel 14A. In the illustrated embodiment, a pair of first fold lines 23, 25 is provided between adjacent pairs of the first severance lines 24. Each of the pair of first fold lines 23, 25 may be arcuate or curvilinear in shape and may be curved in opposition to each other.

The first outer shoulder panel 14A may be further defined in part by a fold line 31 extending from each end edge of the second main panel 14 to the adjacent one of the first severance lines 24.

A first inner marginal side portion 14B may form a first inner shoulder panel 14B in an erected condition.

The first inner shoulder panel 14B is defined in part by the fold line 15 between the second main panel 14 and the third main panel 16. The first inner shoulder panel 14B is defined in part by the second severance lines 26 of each of the article engagement structures N provided within second main panel 14.

At least one second fold line 27, 29 may be provided between adjacent pairs of the second severance lines 26. The at least one second fold line 27, 29 defines in part the first inner shoulder panel 14B. In the illustrated embodiment, a pair of second fold lines 27, 29 is provided between adjacent pairs of the second severance lines 26. Each of the pair of second fold lines 27, 29 may be arcuate or curvilinear in shape and may be curved in opposition to each other.

The first inner shoulder panel 14B may be further defined in part by a fold line 32 extending from each end edge of the second main panel 14 to the adjacent one of the first severance lines 24.

The third main panel 16 comprises opposed marginal side portions 16A, 16B. A second outer marginal side portion 16A may form a second outer shoulder panel 16A in an erected condition. A second inner marginal side portion 16B may form a second inner shoulder panel 16B in an erected condition. The second inner and outer shoulder panels 16B, 16A are substantially similar in construction to the first inner and outer shoulder panels 16B, 16A.

The first and second inner shoulder panels 14B, 16B together may form a keel structure disposed between two rows of articles B in a set up carrier 90. The keel structure may take the form of a "V" shaped valley or trough.

In other embodiments the article engagement structures N may be omitted or may take a different form, such as but not limited to an aperture surrounded by a plurality of foldable tabs for engaging with an article B.

In some embodiments the top panel 14/16 may form a substantially planar cover disposed over the upper ends of the articles B.

Optionally, each of the first and second inner shoulder panels 14B, 16B comprises relief elements in the form of fold lines 41, 43, 45, 47 disposed proximate an end edge of a respective one of the first and second inner shoulder panels 14B, 16B.

The blank 10 comprises at least one glue flap 20, 22. The illustrated embodiments comprises two glue flaps 20, 22.

A first glue flap 20 is hingedly connected to the first main panel 12 along a hinged connection in the form of a fold line 19.

The first glue flap 20 extends outwardly or downwardly from the first main panel 12. In the illustrated embodiment the first glue flap 20 is struck from (or defined in), at least in part, the first main panel 12. That is to say that the first glue flap 20 is provided from material which would otherwise form part of the first main panel 12. The first glue flap 20 is defined in part by cut lines 19A, 19B extending from opposing ends of the fold line 19.

In other embodiments, the first glue flap 20 may be hinged to a lowermost (or outermost) edge of the first main panel 20 in such embodiments the cut lines 19A, 19B may be omitted.

A second glue flap 22 is hingedly connected to the fourth main panel 18 along a hinged connection in the form of a fold line 21.

The second glue flap 22 extends outwardly or downwardly from the fourth main panel 18. The second glue flap 22 is arranged substantially similarly to the first glue flap 20. The second glue flap 22 is hinged to the fourth main panel 18 by a fold line 21 and is defined in part by a pair of cut lines 21A, 21B extending from ends of the fold line 21.

Figure 7:
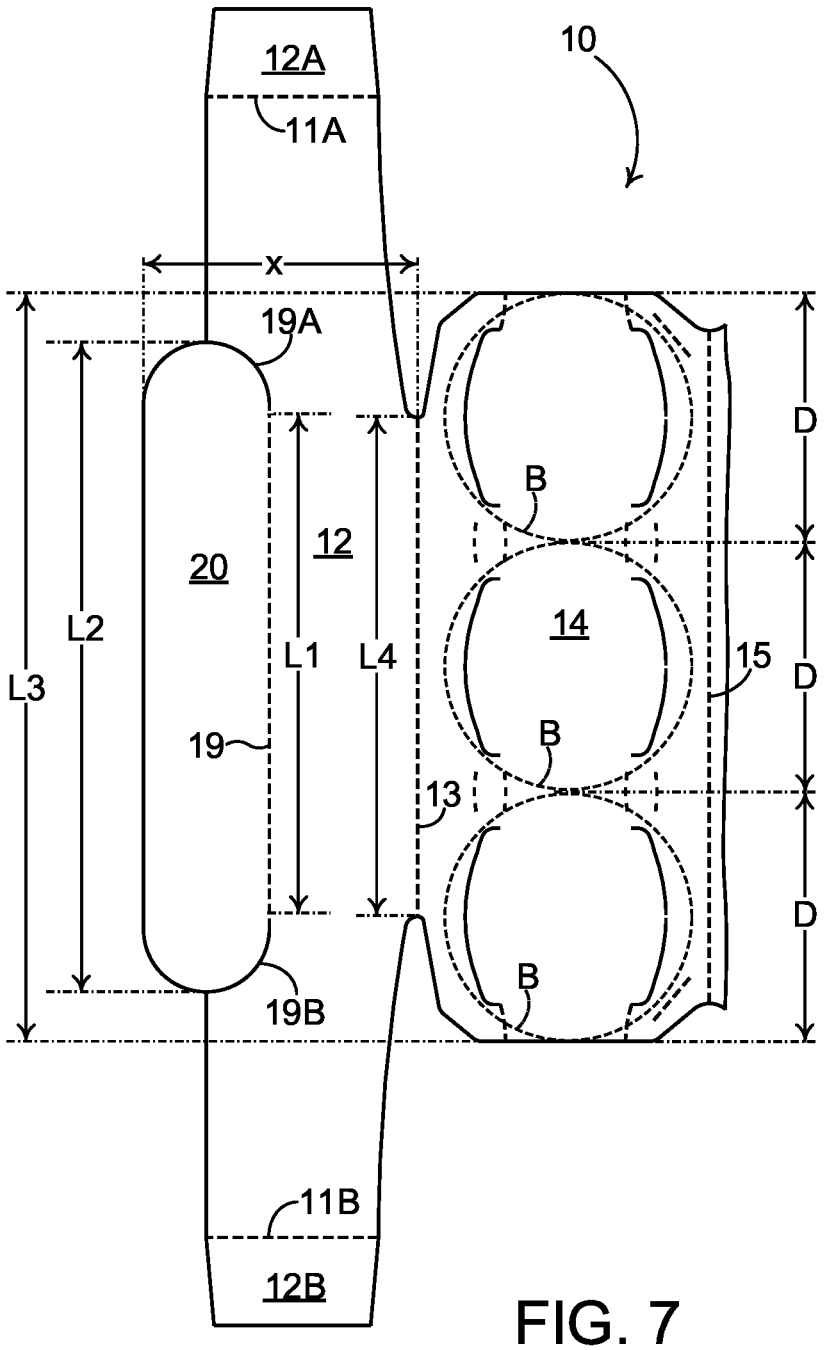
FIG. 7 is a plan view from above of a portion of the blank of FIG. 1 showing the position of a row of articles relative to the top panel.

Referring to FIG. 7 there is shown a portion of the blank 10 of FIG. 1, the outline of articles B is shown by dashed lines. Each of the articles B is generally cylindrical and comprises a diameter or width D.

The fold line 19 comprises a linear length dimension L1.

The length L1 of the fold line 19 may be equal to or less than D×(N−1) where "D" is the diameter of the body portion of each generally cylindrical article B and "N" is the number of the generally cylindrical articles in the row with which the side strap 12 is in contact; in the illustrated embodiment N=3. The body portion may provide the widest part, or greatest diameter region, of the article B. In other embodiments the widest part (greatest diameter region) of the article B may be provided by a different portion of the article B. "D" may be the maximum diameter or width of the articles B being packaged.

The length L1 of the fold line 19 may be less than the length L2 of the first glue flap 20 which may be less than the length L3 of the top panel 14/16 (or second main panel 14).

The length L1 of the fold line 19 may be generally equal to the length L4 of the fold line 13 between the first main panel 12 and the second main panel 14.

The fold line 19 is arranged to extend linearly (straight) entirely between its opposite ends in a loaded package or when the carrier 90 is fully loaded with articles B. That is to say the fold line 19 does not extend about corners or ends of the group of articles B being packaged. The fold line 19 is contained within a substantially planar region PR (see FIG. 6) of the strap 12 disposed along a side of the group of articles B being packaged. The fold line 19 does not extend into regions of the strap 12 which may form end walls of the sleeve.

The fold line 19 may be arranged such that it does not extend beyond the centres of the endmost articles B. In this way the fold line 19 may not be deformed about the ends of said articles B such that the fold line 19 is substantially linear and is provided in a substantially planar portion of the strap 12 that extends along a side of the group of articles B being packaged.

Figure 2:
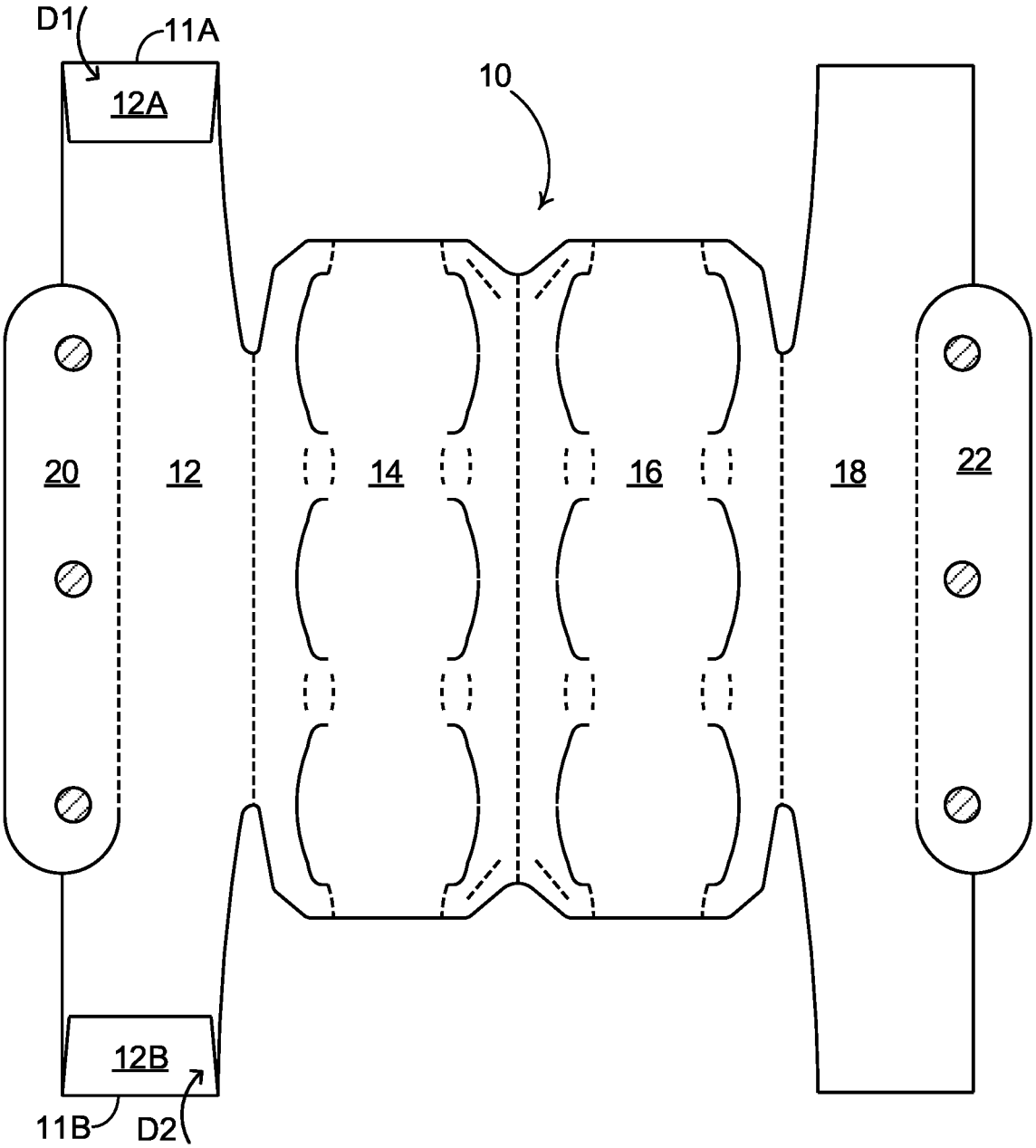
FIGS. 2 and 3 show stages of construction of the blank of FIG. 1 into a flat collapsible sleeve arrangement.
Figure 3:
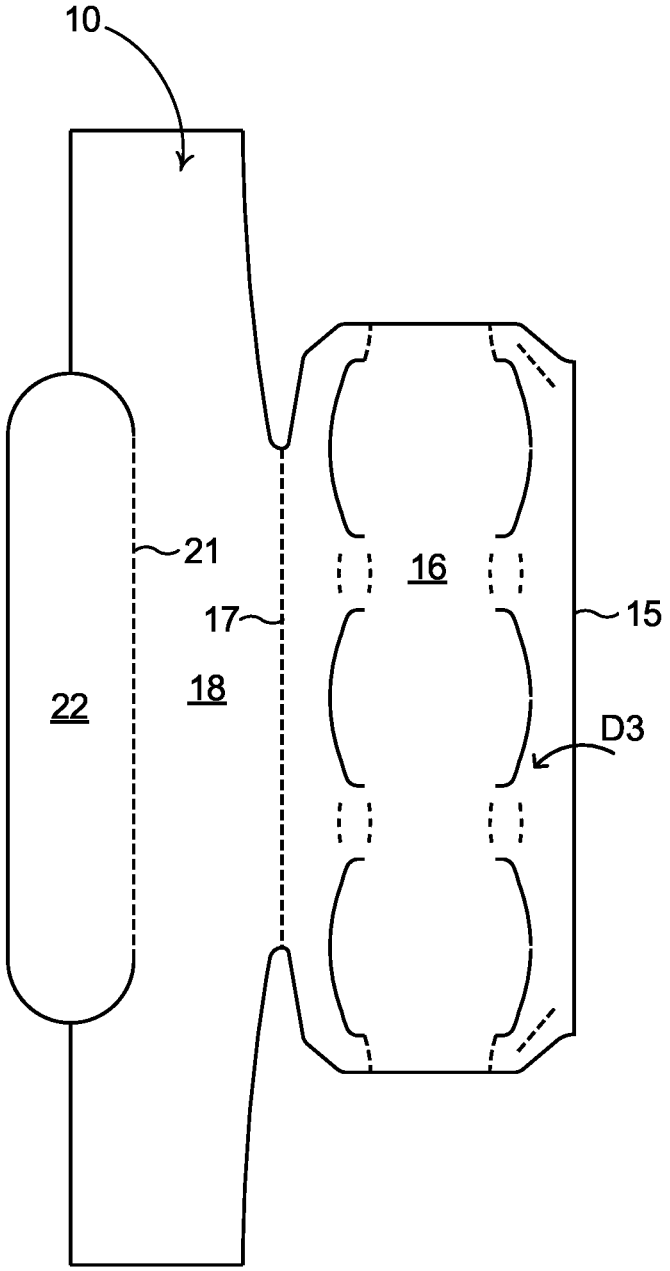

Turning to the construction of the carrier 90 from the blank 10, the blank 10 may be formed into a flat collapsible sleeve as shown in FIG. 3. The opposed marginal end portions 12A, 12B are folded about fold lines 11A, 11B to be disposed in face to face relationship with the intermediate portion of the first main panel 12 as indicated in FIG. 2 by direction arrows D1, D2.

Glue or other adhesive treatment may be applied to the opposed marginal end portions 12A, 12B or to corresponding regions of the fourth main panel 18.

The blank is folded about fold line 15, as indicated in FIG. 3 by direction arrow D3 to bring the third main panel 16 into face to face relationship with the second main panel 14 and the fourth main panel 18 into face to face relationship with the first main panel 12.

The fourth main panel 18 is secured to the opposed marginal end portions 12A, 12B of the first main panel 12.

In other embodiments the blank may be folded about fold line 15 prior to folding the opposed marginal end portions 12A, 12B are folded about fold lines 11A, 11B such that the opposed marginal end portions 12A, 12B are secured to an outer surface of the fourth main panel 18.

Figure 4:
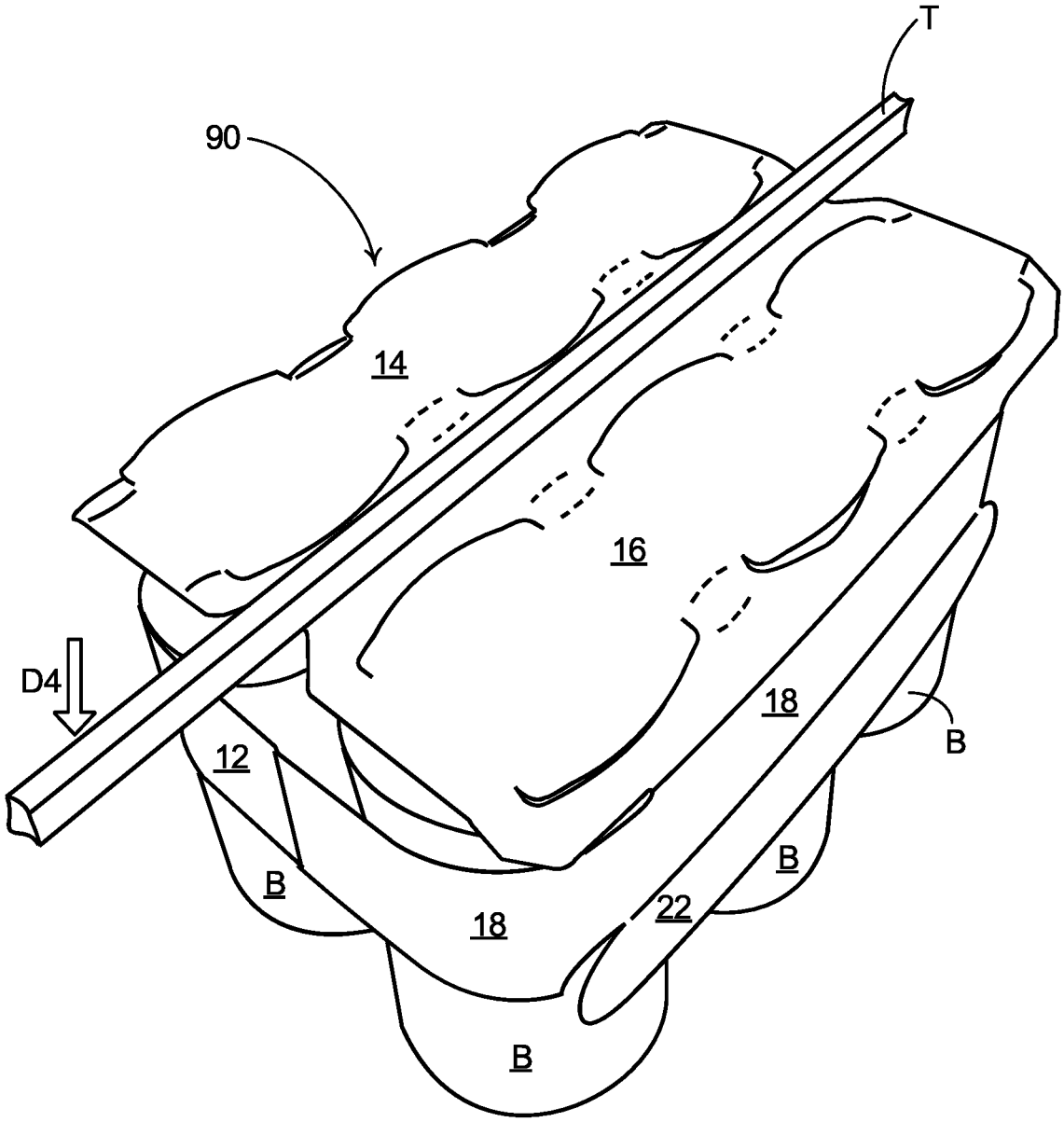
FIG. 4 is a perspective view from above of an erected sleeve being formed about a group of articles.

The flat collapsible sleeve is opened to form a sleeve closed at an upper end and having an open lower end. The erected sleeve is loaded though the open bottom end with articles B as shown in FIG. 4.

The sleeve is applied to a group of articles B. The sleeve is lowered with respect to the group of articles B.

The first and fourth main panels 12, 14 form a strap extending about the group of articles B. The second and third main panels 14, 16 form a top panel 14/16 disposed over the group of articles B, as shown in FIG. 4.

The first outer marginal side portion 14A and the second first outer marginal side portion 16A are folded about shoulders or necks of the articles B to form outer shoulder panels 14A, 16A. In doing so the first severance lines 24 are opened to create openings in the top panel 14/16, the openings receive an outer portion of a respective article B. The first severance lines 24 each define a tab extending from medial regions of the second or third main panels 14, 16 which tabs extend over an upper end of a respective article B in the group of articles B.

Each of the first severance lines 24 also define an engaging edge provided by the first or second outer marginal side portion 14A, 16A; the engaging edge engages with the article B below a lip, flange or other projection. In embodiments where the articles B are beverage cans the flange may be provided by an end seam such as a canners end seam.

A tool T such as but not limited to a static guide may be provided in a packaging machine to facilitate engagement of the first and second inner marginal side portions 14B, 16B with the articles B.

The tool T encourages the fold line 15 between the first and second inner marginal side portions 14B, 16B in a downward direction, as indicted by direction arrow D4.

This has the effect of engaging the first and second inner marginal side portions 14B, 16B with the articles B. The second severance lines 26 are opened to create openings in the top panel 14/16, the openings receive an inner portion of a respective article B. The second severance lines 26 each define a tab extending inwardly from medial regions of the second or third main panels 14, 16 which tabs extend over an upper end of a respective article B in the group of articles B.

Each of the second severance lines 26 also define an engaging edge provided by the first or second inner marginal side portion 14B, 16B; the engaging edge engages with the article B below a lip, flange or other projection. In embodiments where the articles B are beverage cans the flange may be provided by an end seam such as a canners end seam.

The first and second inner marginal side portions 14B, 16B form a "V" shaped keel structure between the rows of articles B, bracing the articles B.

Figure 5:
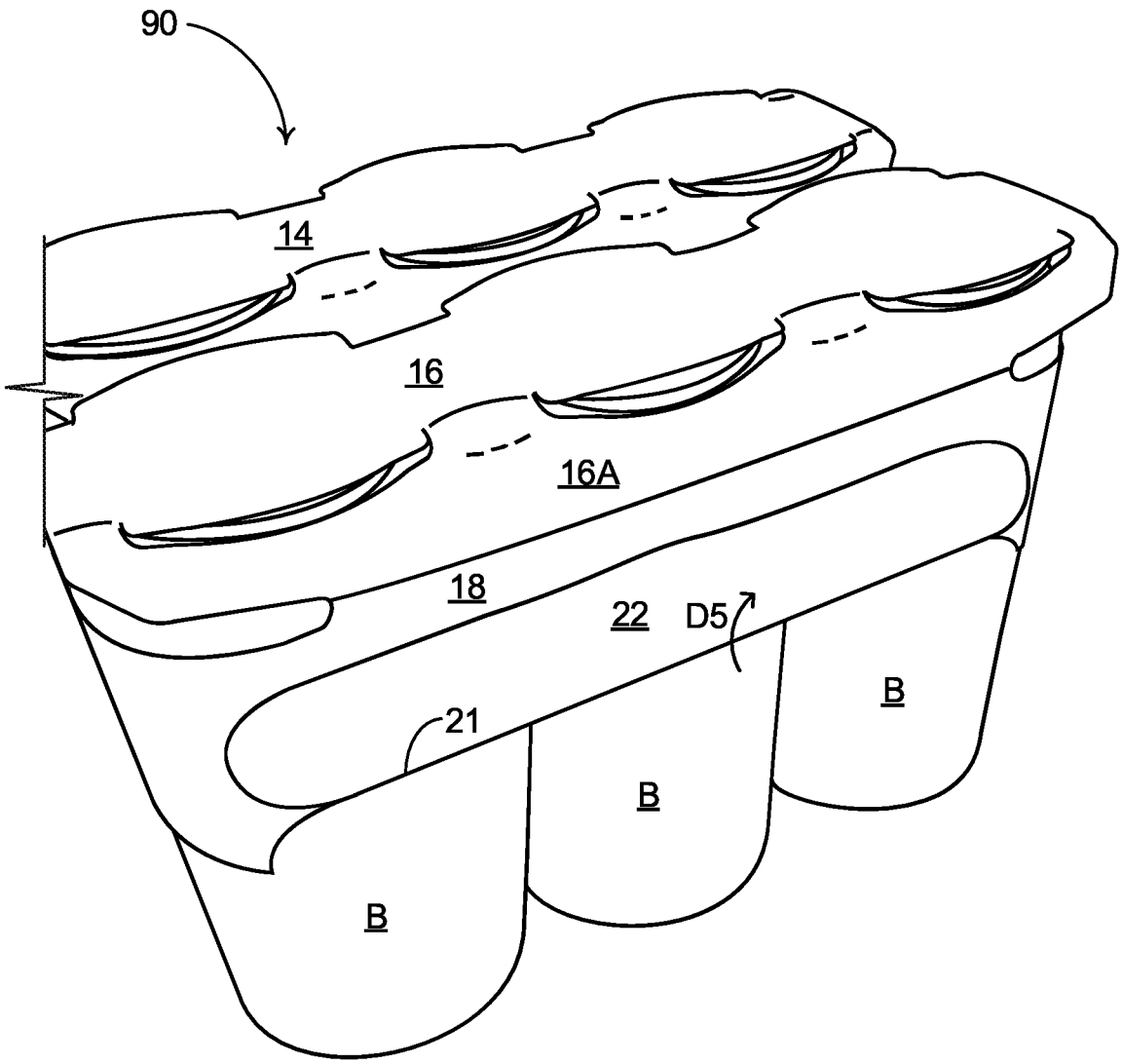
FIG. 5 is a perspective view from above of an article carrier formed from the blank of FIG. 1 in a stage of construction.

The first and second glue flaps 20, 22 are folded outwardly, as indicated by direction arrow D5 in FIG. 5, from the group of articles B to expose a region of the articles B disposed therebehind.

Glue or other adhesive treatment may be applied to an exposed region of each article B or to a respective one of the first and second glue flaps 20, 22. FIG. 1 illustrates glue regions G for securing the first and second glue flaps 20, 22 to the articles B.

The first and second glue flaps 20, 22 are folded downwardly, as indicated by direction arrow D6 in FIG. 6, towards the group of articles B to be brought into contact with the adjacently disposed articles B.

A fugitive glue may be employed to secure the first and second glue flaps 20, 22 directly to the articles B. An example of a specific glue is Swift 7044 manufactured by HB Fuller. Use of a fugitive glue is optional, an advantage of a fugitive glue is its tendency to remain attached to the carrier 90 when the articles B are disengaged from the carrier 90 (this may be more desirable than having the glue remain attached to the articles B). In alternative embodiments other adhesives maybe employed such as, but not limited to, hot-melt glue.

FIG. 6 shows the carrier 90 in an assembled condition, the carrier 90 comprises a top panel 14/16 disposed over the group of articles B. The carrier 90 may comprise a valley or trough disposed between two rows of articles B. A strap 12/18 is hingedly connected to the top panel 14/16 and extends about or surrounds the sides and ends of the group of articles B. The strap 12/18 is secured to the articles B by a glue panel 20, 22. The glue panel 20, 22 is foldably coupled to the strap 12/18 to facilitate application of glue during a packaging assembly process. The glue panel 20, 22 may allow the assembly process to be readily automated in a packaging machine.

The present disclosure provides an article carrier 90 comprising: a sleeve structure 12/18 defining at least in part an interior of the carrier 90 for receiving at least one article B. The sleeve structure includes at least one substantially planar portion, indicated generally by shaded region PR in FIG. 6. The article carrier 90 comprises a top (or bottom) end closure structure 14A, 14, 14B, 16B, 16, 16A. The top (or bottom) end closure structure 14A, 14, 14B, 16B, 16, 16A is hingedly connected to a first end of the sleeve structure 12/18 to at least partially close the first end. The article carrier 90 comprises at least one glue flap 20, 22 hingedly connected to the planar portion of the sleeve structure 12/18 for pivotal movement with respect to the planar portion. The at least one glue flap 20, 22 is disposed generally in the plane of the planar portion of the sleeve structure 12/18 when the at least one article B is received in the interior of the carrier 90.

The present disclosure also provides a blank 10 for forming an article carrier 90. The blank 10 comprises a pair of straps 12, 18 for forming a sleeve structure 12/18 which defines an interior of the carrier 90 for receiving at least one article B. The blank 10 comprises an (top or bottom) end closure section 14A, 14, 14B, 16B, 16, 16A extending between the pair of straps 12, 18 and hingedly connected along opposed end edges thereof. The blank 10 comprises at least one glue flap 20, 22 hingedly connected to at least one of the straps 12, 18. The at least one glue flap 20, 22 is formed in part from the at least one of the straps 12, 18.

A package is disclosed herein, the package comprises an article carrier 90 and at least one article B. Each article B comprises opposed ends defining a longitudinal axis therebetween. The article B comprises a height dimension h defined between the opposed ends. The height dimension h extending along the longitudinal axis. The carrier 90 comprises a sleeve structure 12/18. An (top or bottom) end closure structure 14A, 14, 14B, 16B, 16, 16A is provided at least partially closing an end of the sleeve structure 12/18. The carrier 90 comprises at least one glue flap 20, 22. The sleeve structure 12/18 defines a sleeve axis and encircles the at least one article such that the sleeve axis is parallel to the longitudinal axis of the at least one article. The end closure structure 14A, 14, 14B, 16B, 16, 16A is hingedly connected to a first end of the sleeve structure 12/18 along at least one first end fold line 13, 17. The end closure structure 14A, 14, 14B, 16B, 16, 16A is disposed at least in part along the end of the at least one article. The at least one glue flap 20, 22 is hingedly connected to the sleeve structure 12/18 along a glue flap fold line 19, 21. The at least one glue flap 20, 22 is adhesively secured to the at least one article B. The at least one glue flap 20, 22 extending from the glue flap fold line 19, 21 to a free edge E1, E2 located at a position opposing the glue flap fold line 19, 21. The height dimension h of the at least one article B is equal to or greater than the distance x between the free edge E1, E2 of the at least one glue flap 20, 22 and the at least one first end fold line 13, 17.

The present disclosure further provides a process for forming a package. The package comprises an article carrier 90 and at least one article B each having a height h and an end and defining a longitudinal axis extending along the height h. The article carrier 90 comprises: a sleeve structure 12/18, an (top or bottom) end closure structure 14A, 14, 14B, 16B, 16, 16A, and at least one glue flap 20, 22. The process comprises:

- moving the at least one of the article carrier 90 relative to the at least one article B, by moving at least one of the article carrier 90 and the at least one article B toward the other such that the sleeve structure 12/18 encircles the at least one article B and such that a sleeve axis of the sleeve structure is parallel to the longitudinal axis of the at least one article;
- bringing the end closure structure 14A, 14, 14B, 16B, 16, 16A to a position in which the end closure structure is disposed at least in part along the first end of the at least one article;
- folding the at least one glue flap 20, 22 with respect to the sleeve structure 12/18 to expose an outside surface of the at least one article B and to exposing an inside surface of the at least one glue flap 20, 22;
- applying an amount of adhesive to one of the outside surface of the at least one article B and the inside surface of the at least one glue flap 20, 22; and
- folding the at least one glue flap 20, 22 back to the initial position and adhesively securing the at least one glue flap 20, 22 to the at least one article B.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, embossed lines, debossed lines, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. An article carrier for packaging at least one article, the article carrier comprising:

a sleeve structure defining at least in part an interior of the article carrier for receiving at least one article, the sleeve structure including at least one substantially planar portion;

an end closure structure hingedly connected to a first end of the sleeve structure to at least partially close the first end; and at least one glue flap hingedly connected to the at least one substantially planar portion of the sleeve structure for pivotal movement with respect to the at least one substantially planar portion, wherein the at least one glue flap is disposed generally in the plane of the at least one substantially planar portion of the sleeve structure when the at least one article is received in the interior of the article carrier.

2. An article carrier according to claim 1 wherein the at least one article comprises a plurality of articles arranged in one or more rows, wherein the end closure structure is hingedly connected, by a fold line, to the first end of the sleeve structure; and wherein the at least one glue flap is hingedly connected, by a hinged connection, to the at least one substantially planar portion of the sleeve structure.

3. An article carrier according to claim 2 wherein the length of the hinged connection is equal to or less than $D\times(N-1)$, where "D" is the diameter of the body portion of an article and "N" is the number of the articles in a row of articles with which the at least one substantially planar portion of the sleeve structure is in contact.

4. An article carrier according to claim 2 wherein at least one glue flap comprises a length dimension and the length of the hinged connection is less than the length dimension of the at least one glue flap.

5. An article carrier according to claim 2 wherein at least one glue flap comprises a first length dimension and the end closure structure provides a top panel having a second length dimension, the first length dimension being less than the second length dimension of the top panel.

6. An article carrier according to claim 2 wherein the length of the hinged connection is generally equal to the length of the fold line.

7. An article carrier according to claim 2 wherein the fold line is arranged to be substantially linear between its opposed ends when the article carrier is fully loaded with articles.

8. A blank for forming an article carrier, the blank comprising a pair of straps for forming a sleeve structure which defines an interior of the article carrier for receiving at least one article, the blank comprising an end closure section extending between the pair of straps and hingedly connected thereto along opposed end edges thereof, wherein the blank comprises at least one glue flap hingedly connected to at least one of the straps, the at least one glue flap is formed in part from the at least one of the straps.

9. A blank according to claim 8 further comprising a plurality of main panels hingedly connected in a linear series by hinged connections.

10. A blank according to claim 9 wherein a first main panel and a second main panel of the plurality of panels form the pair of straps for forming the sleeve structure.

11. A blank according to claim 10 wherein at least one of the first and the second main panels comprise a pair of opposed marginal end portions foldably connected to an intermediate portion of one of the respective first and the second main panels.

12. A blank according to claim 10 wherein a third main panel and a fourth main panel of the plurality of panels are configured to form the end closure section.

13. A blank according to claim 12 wherein the third main panel comprise opposed marginal side portions, wherein one of the opposed marginal side portion is defined by a fold line between the third main panel and the fourth main panel and other of the opposed marginal side portion is defined by a fold line between the third main panel and one of the first and the second main panels, wherein the fourth main panel comprise opposed marginal side portions, wherein one of the opposed marginal side portions is defined by a fold line between the fourth main panel and the third main panel and other of the opposed marginal side portion is defined by a fold line between one of the fourth main panel and other of the first and second main panels.

14. A package comprising an article carrier and at least one article, each article comprising:

opposed ends defining a longitudinal axis therebetween; and a height dimension defined between the opposed ends, the height dimension extending along the longitudinal axis, wherein the article carrier comprises:

a sleeve structure;

an end closure structure at least partially closing an end of the sleeve structure; and at least one glue flap, the sleeve structure defining a sleeve axis and encircling the at least one article such that the sleeve axis is parallel to the longitudinal axis of the at least one article, the end closure structure is hingedly connected to a first end of the sleeve structure along at least one first end fold line, the end closure structure being disposed at least in part along the end of the at least one article, the at least one glue flap is hingedly connected to the sleeve structure along a glue flap fold line, the at least one glue flap is adhesively secured to the at least one article, the at least one glue flap extends from the glue flap fold line to a free edge located at a position opposing the glue flap fold line, and wherein the height dimension of the at least one article is equal to or greater than the distance between the free edge of the at least one glue flap and the at least one first end fold line.

15. A package according to claim 14 wherein the at least one article comprises a plurality of articles arranged in one or more rows, wherein the sleeve structure defining at least in part an interior of the article carrier for receiving the at least one article, the sleeve structure including at least one substantially planar portion;

wherein the end closure structure is hingedly connected, by a fold line, to the first end of the sleeve structure to at least partially close the first end; and wherein the least one glue flap is hingedly connected, by a hinged connection, to the at least one substantially planar portion of the sleeve structure for pivotal movement with respect to the at least one substantially planar portion, wherein the at least one glue flap is disposed generally in the plane of the at least one substantially planar portion of the sleeve structure when the at least one article is received in the interior of the article carrier.

16. A package according to claim 15 wherein the length of the hinged connection is equal to or less than $D\times(N-1)$, where "D" is the diameter of the body portion of an article and "N" is the number of the articles in a row of articles with which the at least one substantially planar portion of the sleeve structure is in contact.

17. A package according to claim 15 wherein at least one glue flap comprises a length dimension and the length of the hinged connection is less than the length dimension of the at least one glue flap.

18. A package according to claim 15 wherein at least one glue flap comprises a first length dimension and the end closure structure provides a top panel having a second length dimension, the first length dimension being less than the second length dimension of the top panel.

19. A package according to claim 15 wherein the length of the hinged connection is generally equal to the length of the fold line.

20. A package according to claim 15 wherein the fold line is arranged to be substantially linear between its opposed ends.

* * * * *